US010827256B2

(12) United States Patent
Kawai et al.

(10) Patent No.: US 10,827,256 B2
(45) Date of Patent: Nov. 3, 2020

(54) ALARM SOUND GENERATING APPARATUS

(71) Applicant: HAMANAKODENSO CO., LTD., Kosai, Shizuoka-pref. (JP)

(72) Inventors: Tatsuya Kawai, Kosai (JP); Yuuya Maebashi, Kosai (JP)

(73) Assignee: HAMANAKODENSO CO., LTD., Shizuoka (JP)

( * ) Notice: Subject to any disclaimer, the term of this patent is extended or adjusted under 35 U.S.C. 154(b) by 0 days.

(21) Appl. No.: 16/744,302

(22) Filed: Jan. 16, 2020

(65) Prior Publication Data

US 2020/0236460 A1 Jul. 23, 2020

(30) Foreign Application Priority Data

Jan. 23, 2019 (JP) ..... 2019-009680

(51) Int. Cl.

| | |
|---|---|
| ***H04R 1/30*** | (2006.01) |
| ***G08B 3/10*** | (2006.01) |
| ***H04R 7/16*** | (2006.01) |
| ***H04R 9/02*** | (2006.01) |
| ***H04R 7/12*** | (2006.01) |
| ***H04R 9/06*** | (2006.01) |

(52) U.S. Cl.

CPC ..... *H04R 1/30* (2013.01); *G08B 3/10* (2013.01); *H04R 7/12* (2013.01); *H04R 7/16* (2013.01); *H04R 9/025* (2013.01); *H04R 9/06* (2013.01)

(58) Field of Classification Search

CPC . H04R 1/30; H04R 9/025; H04R 7/12; H04R 7/16; H04R 9/06; G08B 3/10

USPC .. 340/425.5, 4.4, 328, 384.1, 384.73, 388.1, 340/388.3; 381/160, 340–342, 346–348

See application file for complete search history.

(56) References Cited

U.S. PATENT DOCUMENTS

| | | | | |
|---|---|---|---|---|
| 4,954,805 A * | 9/1990 | Buyak | G08B 3/10 | 340/384.6 |
| 5,596,311 A * | 1/1997 | Bess | B06B 1/0246 | 331/116 R |
| 6,201,470 B1 * | 3/2001 | Withington | G08B 3/10 | 340/309.8 |
| 2013/0098157 A1 * | 4/2013 | Suzuki | G01N 29/24 | 73/597 |
| 2016/0080860 A1 * | 3/2016 | Kobayashi | B60Q 5/00 | 381/340 |

FOREIGN PATENT DOCUMENTS

| | | |
|---|---|---|
| JP | 5132421 B2 | 1/2013 |
| JP | 5410230 B2 | 2/2014 |
| JP | 5546561 B2 | 7/2014 |

* cited by examiner

*Primary Examiner* — Daryl C Pope

(74) *Attorney, Agent, or Firm* — Harness, Dickey & Pierce, P.L.C.

(57) ABSTRACT

An alarm sound generating apparatus includes a spiral pipe extending from a sound wave inlet to a sound wave outlet, and a cover including a reflecting wall configured to reflect a sound wave released from the sound wave outlet. The reflecting wall is distanced from and faces to the sound wave outlet. A distance between the sound wave outlet and the reflecting wall falls within ±10% of an odd multiple of one-fourth of a wavelength calculated from a fundamental frequency of the alarm sound or a multiple harmonic thereof.

6 Claims, 5 Drawing Sheets

FIG. 6

| | FREQUENCY (Hz) | WAVE LENGTH λ (mm) | COVER HEIGHT (mm) * λ/4 |
|---|---|---|---|
| FUNDAMENTAL FREQUENCY | 400 | 850 | 213 |
| SECOND HARMONIC | 800 | 425 | 106 |
| THIRD HARMONIC | 1200 | 283 | 71 |
| FOURTH HARMONIC | 1600 | 213 | 53 |
| FIFTH HARMONIC | 2000 | 170 | 43 |
| SIXTH HARMONIC | 2400 | 142 | 35 |
| SEVENTH HARMONIC | 2800 | 121 | 30 |
| EIGHTH HARMONIC | 3200 | 106 | 27 |

ALARM SOUND GENERATING APPARATUS

CROSS REFERENCE TO RELATED APPLICATION

This application is based on Japanese Patent Application No. 2019-009680 filed on Jan. 23, 2019, the disclosure of which is incorporated herein by reference in its entirety.

TECHNICAL FIELD

The present disclosure relates to an alarm sound generating apparatus.

BACKGROUND

A conventional trumpet horn includes a resonance pipe having a spiral shape and a cover disposed at an end of the resonance pipe to prevent entrance of foreign matters from entering into the resonance pipe.

SUMMARY

One of disclosed alarm sound generating apparatuses is an alarm sound generating apparatus configured to generate an alarm sound. The alarm sound generating apparatus includes a coil, a fixed core, a movable core, a diaphragm, an acoustic pipe, and a cover. The coil generates magnetic force when energized and the fixed core generates magnetic attraction force by the magnetic force generated by the coil. The movable core is configured to move relative to the fixed core by the magnetic attraction force generated by the fixed core. The diaphragm is fixed to the movable core and configured to generate sound waves by oscillating in accordance with movements of the movable core. The acoustic pipe includes a sound passage therein. The sound passage extends from a sound passage inlet to a sound passage outlet. The sound passage inlet is an inlet through which the sound waves generated by the diaphragm enter. The cover includes a reflecting wall distanced from and facing to an outlet end of the acoustic pipe defining the sound passage outlet. The reflecting wall is configured to reflect the sound waves. A distance between the outlet end of the acoustic pipe and the reflecting wall falls within ±10% of an odd multiple of one-fourth of a wavelength calculated from a fundamental frequency of the alarm sound. Alternatively, the distance falls within ±10% of an odd multiple of one-fourth of a wavelength calculated from a multiple harmonic of the fundamental frequency.

BRIEF DESCRIPTION OF THE DRAWINGS

FIG. 6 is a table showing relationships of harmonics, wavelengths, and heights of covers.

DETAILED DESCRIPTION

Figure 1:
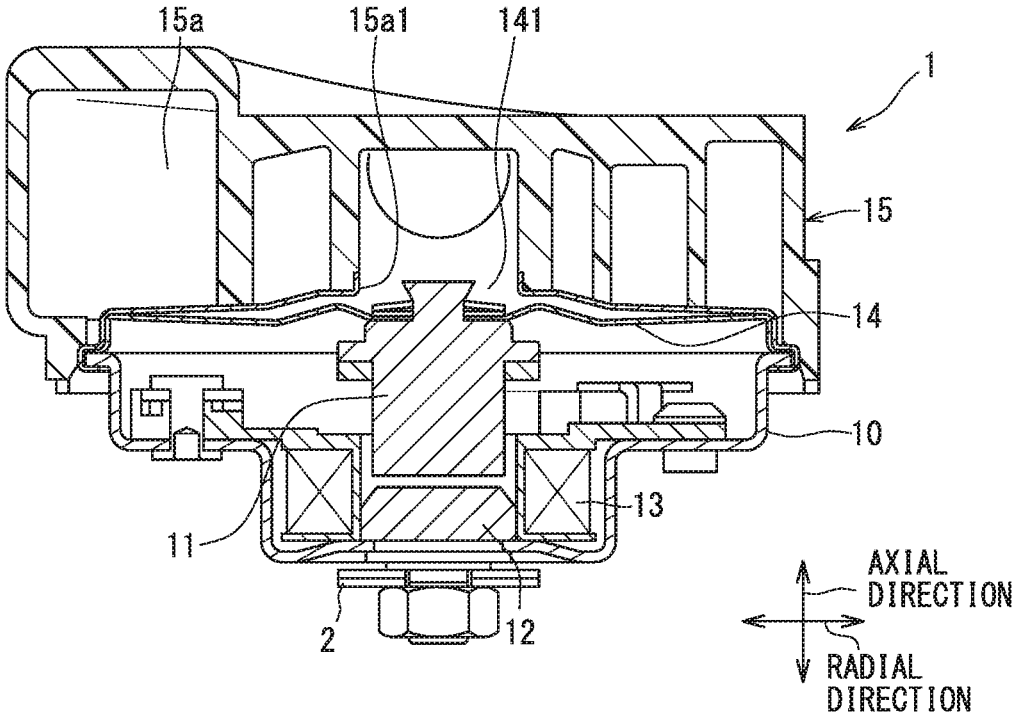
FIG. 1 is a cross-sectional view of an alarm sound generating apparatus according to at least one embodiment.

To begin with, comparative examples of relevant techniques will be described.

A comparative trumpet horn includes a resonance pipe having a spiral shape and a cover disposed at an end of the resonance pipe to prevent foreign matters from entering into the resonance pipe.

The trumpet horn has a certain degree of performance to prevent entrance of foreign matters but leaves room for improvement in a sound pressure level.

The present disclosure provides an alarm sound generating apparatus improved in sound pressure.

One of disclosed alarm sound generating apparatuses is an alarm sound generating apparatus configured to generate an alarm sound. The alarm sound generating apparatus includes a coil, a fixed core, a movable core, a diaphragm, an acoustic pipe, and a cover. The coil generates magnetic force when energized and the fixed core generates magnetic attraction force by the magnetic force generated by the coil. The movable core is configured to move relative to the fixed core by the magnetic attraction force generated by the fixed core. The diaphragm is fixed to the movable core and configured to generate sound waves by oscillating in accordance with movements of the movable core. The acoustic pipe includes a sound passage therein. The sound passage extends from a sound passage inlet to a sound passage outlet. The sound passage inlet is an inlet through which the sound waves generated by the diaphragm enter. The cover includes a reflecting wall distanced from and facing to an outlet end of the acoustic pipe defining the sound passage outlet. The reflecting wall is configured to reflect the sound waves.

A distance between the outlet end of the acoustic pipe and the reflecting wall falls within ±10% of an odd multiple of one-fourth of a wavelength calculated from a fundamental frequency of the alarm sound. Alternatively, the distance falls within ±10% of an odd multiple of one-fourth of a wavelength calculated from a multiple harmonic of the fundamental frequency.

In the alarm sound generating apparatus, an antinode of the sound wave is located at the outlet end of the acoustic pipe defining the sound passage outlet. The distance between the outlet end of the acoustic pipe and the reflecting wall falls within the above-mentioned range, the alarm sound generating apparatus is thereby able to position a node of the sound wave at the reflecting wall. Since the node of the wave form can be positioned at the reflecting wall, a standing wave of the alarm sound is reflected. Thus, the alarm sound generating apparatus can provide reflected waves that are less likely to reduce a resonance effect of the acoustic pipe. Accordingly, the alarm sound generating apparatus can release the alarm sound from the outlet end of the acoustic pipe defining the sound passage outlet while the resonance effect is increased sufficiently. The present disclosure provides an alarm sound generating apparatus improved in a sound pressure.

Hereinafter, embodiments of the present disclosure will be described referring to drawings. A part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination. An alarm sound generating apparatus according to an embodiment will be described with reference to FIGS. 1 to 6. The alarm sound generating apparatus generates an alarm sound from a horn. In this embodiment, a vehicular horn 1 mountable in various vehicles is described as one example of the alarm sound generating apparatus. The horn 1 utilizes, for example, a magnetic force change depending on change in voltage applied to a coil 13 and releases an alarm sound within an audible frequency range toward the outside of the vehicle.

The horn 1 releases the alarm sound toward the outside of the vehicle when a predetermined operational unit in the vehicle is operated. The predetermined operational unit may be a horn switch, e.g. a horn button on a steering, operated by an occupant of the vehicle. The horn 1 is an electromagnetic horn to generate an alarm sound in response to a voltage signal outputted by a driving unit.

Figure 4:
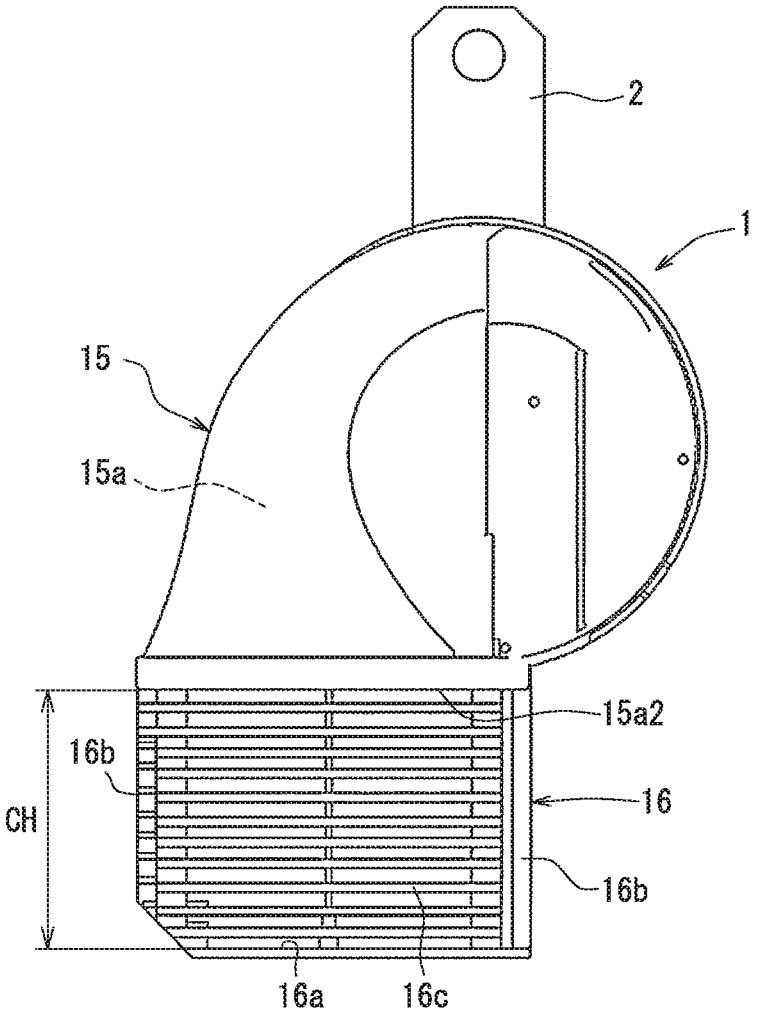
FIG. 4 is an external view of the alarm sound generating apparatus according to at least one embodiment.

FIG. 1 is a schematic view illustrating components of the horn 1 as one example of the alarm sound generating apparatus. The horn 1 may be mounted through a stay 2 in a front part of the vehicle, for example, in front of a radiator. As shown in FIG. 4, the horn 1 is mounted in the vehicle such that the stay 2 is located on a top of the apparatus, and a reflecting wall 16*a* is located on a bottom of the apparatus. An axial direction of a movable core 11 is along a front-rear direction of the vehicle, and a sound releasing opening 16*c* faces frontward of the vehicle.

The horn 1 includes the coil 13 generating magnetic farce when energized, a fixed core 12 generating magnetic attraction force by the magnetic force generated by the coil 13, and the movable core 11 supported to be movable toward the fixed core 12. The movable core 11 is fixed to and supported by a center part of a diaphragm 14 in a radial direction of the movable core 11. The diaphragm may be referred to as a vibration sheet. A circumferential edge of the diaphragm 14 is fixed to a housing 10 that houses or is provided with a driving mechanism of the horn 1. The diaphragm 14 covers an opening of the housing 10. The diaphragm 14 is located in a vibration chamber 141 that is between the opening of the housing 10 and a sound passage inlet 15*a*1 of a spiral pipe 15. The circumferential edge of the diaphragm 14 is curled and crimped to be fixed to an outer peripheral edge of the housing 10. The movable core 11 includes a small diameter projection on a front side of the movable core 11, and the small diameter projection is inserted in and fixed by crimping to the center part of the diaphragm 14.

Figure 2:
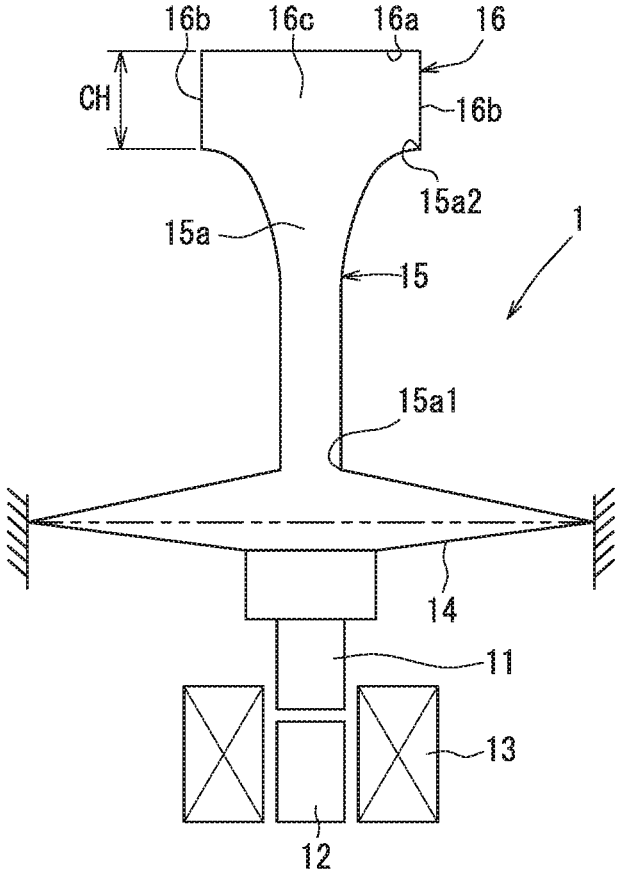
FIG. 2 is a schematic view illustrating a traveling of sound in the alarm sound generating apparatus.

As shown in FIG. 2, when the movable core 11 is moved by magnetic attraction force generated by the fixed core 12, the center part of the diaphragm 14 moves together with the movable core 11 while the circumferential edge of the diaphragm 14 is fixed to the housing 10. As a result, the diaphragm 14 is deformed. When a reduced or no voltage is applied to the coil 13, the magnetic attraction force of the fixed core 12 is weakened and thus the movable core 11 intends to back to an initial position by elastic force of the diaphragm 14. When the voltage applied to the coil 13 is increased again, the movable core 11 is attracted toward the fixed core 12 by the magnetic attraction force of the fixed core 12. Repetition of these actions oscillates the diaphragm 14 and vibrates air. Accordingly, the horn 1 generates the alarm sound. That is, adjustment in distance between the fixed core 12 and the movable core 11 enables the horn 1 to generate an alarm sound having a high quality and a high performance.

As shown in FIG. 2, the horn 1 includes the spiral pipe 15 forming a sound passage 15*a* to amplify the alarm sound generated by the oscillation of the diaphragm 14 and to release the alarm sound toward the outside of the vehicle. The spiral pipe 15 is fixed to the housing 10. The spiral pipe 15 is one example of an acoustic pipe utilizing a resonance effect. The spiral pipe 15 defines the sound passage 15*a* having a spiral shape, but the spiral pipe 15 may be replaced with a trumpet shape member having an opening in which a cross-sectional area increases in a direction toward an outlet of the trumpet shape member.

The spiral pipe 15 defines therein the sound passage 15*a* through which sound waves generated by the oscillation of the diaphragm 14 travel. A sound passage inlet 15*a*1 of the sound passage 15*a* faces the vibration chamber 141 and communicates with the diaphragm 14 through the vibration chamber 141. The sound passage 15*a* defines a passage that has a spiral shape and is centered around the sound passage inlet 15*a*1. A sound passage outlet 15*a*2 of the sound passage 15*a* is defined by an outlet end of the spiral pipe 15 (i,e., an opening end of the spiral pipe 15). The outlet end of the spiral pipe 15 has a rectangular shape, thus the sound passage outlet 15*a*2 has a rectangular shape.

Figure 3:
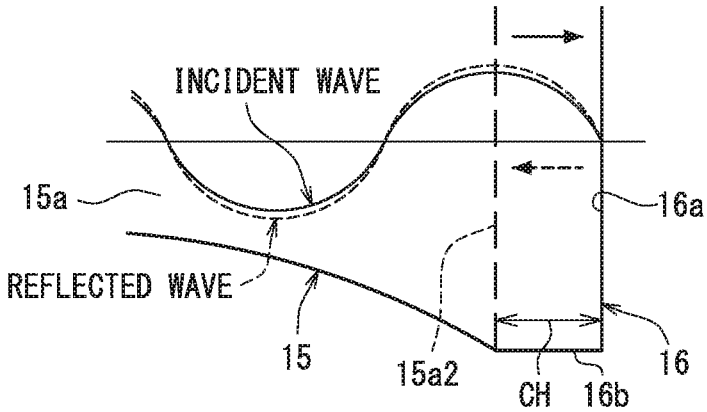
FIG. 3 is a schematic view illustrating a sound wave traveling to a cover of the alarm sound generating apparatus.

As shown in FIGS. 2 to 4, the horn 1 includes the reflecting wall 16*a* configured to reflect sound waves released from the sound passage outlet 15*a*2. The reflecting wall 16*a* is a wall distanced from and facing to the outlet end of the spiral pipe 15 defining the sound passage outlet 15*a*2. The reflecting wall 16*a* is located to be parallel with a rectangular outlet end of the sound passage outlet 15*a*2.

The reflecting wall 16*a* is disposed on a cover 16. The cover 16 includes at least a back wall connecting the outlet end of the spiral pipe 15 and the reflecting wall 16*a*. The back wall is on a backside of the horn 1 that is opposite to an alarm releasing side of the horn 1 from which the alarm sound is released. In other words, the outlet end of the spiral pipe 15 and the reflecting wall 16*a* may only have to be connected at least with the back wall. The cover 16 defines at least the sound releasing opening 16*c*, which has a rectangular shape, on a front side of the horn 1 that is the alarm releasing side of the horn 1. The sound releasing opening 16*c* is between the outlet end of the spiral pipe 15 defining the sound passage outlet 15*a*2 and the reflecting wall 16*a*.

The cover 16 has openings on the front side of the horn 1, which is the alarm releasing side, and on right-left sides of the horn 1. These openings are covered with a lattice, a mesh, or the like to prevent foreign matters from entering into the openings. The horn 1 is capable of releasing the alarm sound from the openings on the front side and the right-left sides of the cover 16.

The cover 16 may include a pair of sidewalls 16*b* connecting the reflecting wall 16*a* and opposite edges of the outlet end that defines the sound passage outlet 15*a*2. The sidewalls 16*b* are plate members extending downward from whole areas of two opposite edges of the outlet end of the spiral pipe 15 to the reflecting wall 16*a*. The two opposite edges are neither an edge on the front side nor an edge on the back side of the outlet end of the spiral pipe 15. In this configuration, the cover 16 defines a front opening on the front side of the horn 1 from which the alarm sound is released. The front opening is covered with a lattice, a mesh, or the like to prevent foreign matters from entering into the front opening. The horn 1 is capable of releasing the alarm sound from the front opening while the pair of the right-left sidewalls 16*b* guides sound waves of the alarm sound to travel frontward. Therefore, the alarm sound can reach further frontward.

The alarm sound of the horn 1 includes a sound synthesized from a sound wave of a fundamental frequency and sound waves of its multiple harmonics. An overall sound pressure level that indicates intensity of the alarm sound is calculated by summing up sound pressures of each sound to be synthesized. Thus, the sound pressure of each sound needs to be increased for enhancing the intensity of the alarm sound. To enhance the sound pressure of each sound, for example, the sound waves traveling through the outlet end in the sound passage 15*a* of the spiral pipe 15 may be prevented from being largely attenuated. For example, the horn 1 of the present embodiment may be configured to reduce phase difference between a reflected wave reflected by the reflecting wall 16*a* and an incident sound wave traveling through the outlet end in the spiral pipe 15.

In the horn 1, a distance CH between the outlet end of the spiral pipe 15 and the reflecting wall 16*a* is set to fall within ±10% of an odd multiple of one-fourth of a wavelength calculated from the fundamental frequency of the alarm sound. Alternatively, the distance CH is determined to fall within ±10% of an odd multiple of one-fourth of a wavelength calculated from a multiple harmonic of the fundamental frequency of the alarm sound. That is, the horn 1 includes the reflecting wall 16*a* facing the outlet end of the spiral pipe 15 such that the distance CH satisfies the above-stated ranges. Even if the horn 1 is designed such that the distance CH is exactly an odd multiple of one-fourth of the wavelength, the horn 1 may have ±10% variation in the distance CH according to size precision of a component and assembling accuracy in production. In addition, such range within ±10% of the center frequency due to variation can achieve the above-described effects, i.e. reduce phase difference between the reflected wave and the incident sound wave.

The fundamental frequency of the alarm sound corresponds to a rated sound frequency specified in a regulation for a horn (ECE No. 28). The regulation for a horn is regulated by United Nations Economic Commission for Europe based on the agreement concerning reciprocal recognition of approvals for wheeled vehicles and equipment and the like. The fundamental frequency is the lowest one of frequencies greater than a predetermined sound pressure level of sounds detected in range between 0 and 600 Hz at 2 meters distance of a specified measuring environment by using a specified measuring instrument according to the regulation for a horn. The fundamental frequency is also the lowest frequency of peaks of multiple sound pressures within the range between 0 and 600 Hz measured by the measurement method according to the regulation for a horn. The predetermined sound pressure level may be 60 dB (A). Harmonic waves in this description are defined as sound waves having frequencies that is natural numbers multiple of the fundamental frequency. The harmonic frequencies in this description are defined as frequencies calculated by multiplying the fundamental frequency with natural numbers.

Figure 5:
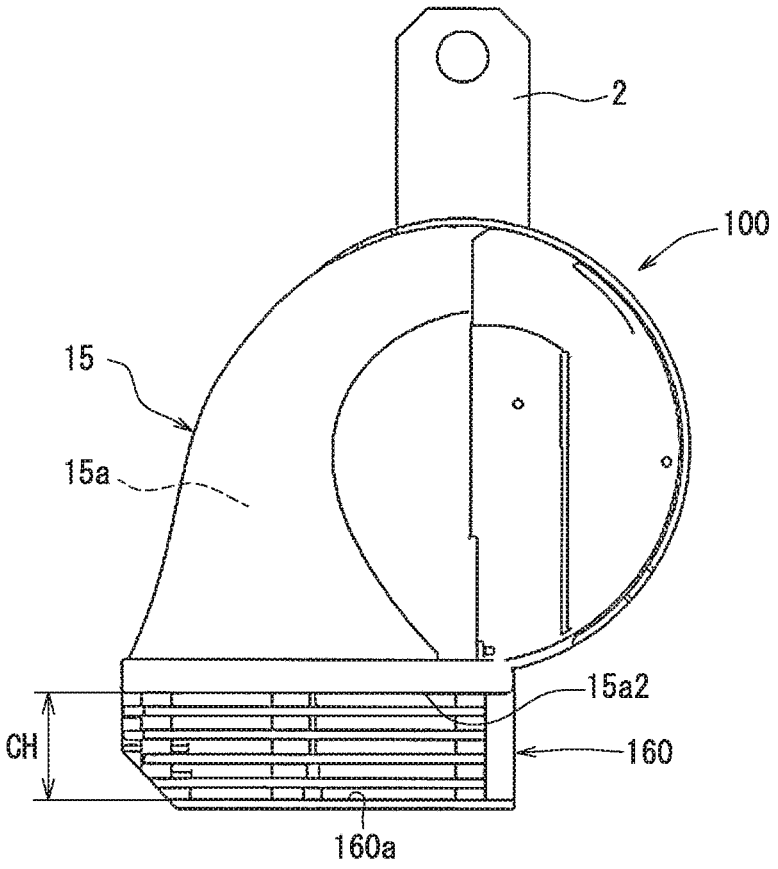
FIG. 5 is an external view of an alarm sound generating apparatus according to a comparative example.

The distance CH between the reflecting wall 16*a* and the outlet end of the spiral pipe 15 in the horn 1 shown in FIG. 4 is enough long compared to a distance CH between a reflecting wall 160*a* of a cover 160 and the outlet end of the spiral pipe 15 in a comparative horn 100 shown in FIG. 5. The distance CH in the comparative horn 100 is about 10 mm, in contrast, the distance CH in the horn 1 of the present embodiment is set to be longer than 20 mm.

The fundamental frequency that is specified in the regulation for a horn (ECE NO. 28) is about 400 Hz for a low tone, and about 480 Hz for a high tone. FIG. 6 is a table showing relations of the fundamental frequency, harmonic frequencies, wavelengths thereof, and heights of the covers, in the case where the fundamental frequency is 400 Hz.

As shown in FIG. 6, in the case where the fundamental frequency is 400 Hz, wavelengths of the second harmonic, the third harmonic, the fourth harmonic, and the fifth harmonic are 425 mm, 283 mm, 213 mm, and 170 mm, respectively. The wavelengths in FIG. 6 are calculated by a formula "sound speed c=frequency f×wavelength λ". The wavelengths and one-fourth of the wavelengths from the fundamental frequency to eighth harmonic frequency are shown in FIG. 6. The distance CH in the horn 1 may be set to be one-fourth of the wavelengths shown as the cover heights in FIG. 6. Each of one-fourth of harmonic frequencies shown in FIG. 6 is obviously greater than the distance CH of the comparative horn 100 shown in FIG. 5. Therefore, the sound pressure can be increased in the horn 1.

The distance CH between the outlet end of the spiral pipe 15 and the reflecting wall 16*a* in the horn 1 may be set to fall within ±10% of one-fourth of the wavelength calculated from the fundamental frequency of the alarm sound. Alternatively, the distance CH may be set to fall within ±10% of one-fourth of a wavelength calculated from a harmonic frequency of the fundamental frequency.

The harmonic frequency may be obtained by multiplying the fundamental frequency with three, four, five or six. In other words, the harmonic frequency may be any one of third, fourth, fifth and sixth harmonics of the fundamental frequency of the alarm sound. The distance CH between the outlet end of the spiral pipe 15 and the reflecting wall 16*a* may fall within ±10% of one-fourth of the wavelength calculated from a harmonic frequency selected from the third to sixth harmonics. In the present embodiment, a sound pressure level of the horn 1 has been measured while the fundamental frequency is 400 Hz and the distance CH is 53 mm that is one-fourth of the wavelength of the fourth harmonic. Accordingly, improvement in sound pressure level can be confirmed. The sound pressure level of the horn 1 has been improved by 1 dB compared with the sound pressure level of the comparative horn 100 shown in FIG. 5.

Furthermore, the distance CH between the outlet end of the spiral pipe 15 and the reflecting wall 16*a* falls within ±10% of one-fourth of a wavelength calculated from a fourth or a fifth harmonic of the fundamental frequency of the alarm sound.

Hereinafter, effects brought by the horn 1 in the embodiment will be described. The horn 1 includes the acoustic pipe and the cover 16. The acoustic pipe includes the sound passage 15*a* therein extending from the sound passage inlet 15*a*1 to the sound passage outlet 15*a*2. The sound passage inlet 15*a*1 is an inlet through which sound waves generated by the diaphragm 14 enter. The cover 16 includes the reflecting wall 16*a* distanced from and facing to the outlet end of the acoustic pipe defining the sound passage outlet 15*a*2. The reflecting wall 16*a* is configured to reflect the sound waves. The distance CH between the outlet end of the acoustic pipe and the reflecting wall 16*a* falls within ±10% of an odd multiple of one-fourth of a wavelength calculated from the fundamental frequency of the alarm sound. Alternatively, the distance CH falls within ±10% of an odd multiple of one-fourth of a wavelength calculated from a multiple harmonic of the fundamental frequency.

In the horn 1, an antinode of the sound wave is located at the outlet end of the acoustic pipe as shown in FIG. 3. The distance CH between the outlet end of the acoustic pipe and the reflecting wall 16*a* in the horn 1 falls within ±10% of an odd multiple of one-fourth of a wavelength calculated from the fundamental frequency or its multiple harmonic of the alarm sound. Thus, a node of the sound wave can be positioned at the reflecting wall 16*a*. Since the reflecting wall 16*a* can be positioned at the node of the sound wave, the standing wave is reflected as shown in FIG. 3, and thus the horn 1 can reduce an influence attenuating the sound waves traveling through the sound passage 15*a*. Therefore, the horn 1 can provide a reflected wave that is less likely to reduce the resonance effect of the acoustic pipe. Accordingly, the horn 1 can release the alarm sound from the outlet end of the acoustic pipe defining the sound passage outlet 15*a*2 while the resonance effect is increased sufficiently. The horn 1 can improve the sound pressure.

The distance CH between the outlet end of the acoustic pipe and the reflecting wall 16*a* falls within ±10% of one-fourth of the wavelength calculated from the fundamental frequency of the alarm sound. Alternatively, the distance CH falls within ±10% of one-fourth of a wavelength calculated from a multiple harmonic of the fundamental frequency. This configuration allows the distance CH to be shorter. Thus, the horn 1 can improve the sound pressure and reduce a size of the cover 16.

The distance CH between the outlet end of the acoustic pipe and the reflecting wall 16*a* falls within ±10% of one-fourth of the wavelength calculated from any one of the third, fourth, fifth, and sixth harmonics. This configuration allows locating the reflecting wall 16*a* such that the distance CH is further shortened. Thus, the horn 1 can further reduce the size of the cover 16.

The distance CH between the outlet end of the acoustic pipe and the reflecting wall 16*a* falls within ±10% of one-fourth of the wavelength calculated by the fourth harmonic or the fifth harmonic, which is obtained by multiplying the fundamental frequency of the alarm sound with four or five. This configuration allows to locate the reflecting wall 16*a* such that the distance CH is much shorter compared to a configuration in which the distance CH is one-fourth of the wavelength calculated from the fundamental frequency. Thus, the horn 1 can reduce the size of the cover 16.

The cover 16 includes the pair of sidewalls 16*b* connecting opposite edges of the outlet end of the acoustic pipe and the reflecting wall 16*a*. The pair of the sidewalls 16*b* guides the sound wave of the alarm sound and enables the alarm sound of the horn 1 to reach further away.

The disclosure in the description is not limited in the embodiments described above. The disclosure includes the embodiments described above and variations from the embodiments by a person skilled in the art. For example, the disclosure is not limited to the combinations of members and elements described in the embodiments and can be achieved by being modified appropriately or combined variously. The disclosure can include additional elements that can be added appropriately to the embodiments. The disclosure includes omissions of the members and the elements in the embodiments. The disclosure includes replacements or combinations of the members and elements between one embodiment and other embodiments. The technical features of the disclosure are not limited to the description of the embodiments. The technical features of the disclosure are indicated by the description in claims and it should be understood that the technical features in the disclosure includes the description of the claims, equivalents, and all alternations in the range of claims and equivalents.

The horn 1 in the embodiment described above includes the sound releasing opening 16*c* which does not include an opening, but the sound releasing opening 16*c* may include an opening such as a through hole. The sound releasing opening 16*c* of the horn 1 is covered with a lattice and the like, but the horn 1 may include a sound releasing opening 16*c* that is not covered and opens entirely.

The cover 16 described above in embodiments may be attached to the spiral pipe 15 as another member from the spiral pipe 15 or may be a part of the spiral pipe 15.

What is claimed is:

1. An alarm sound generating apparatus configured to generate an alarm sound, the apparatus comprising:

a coil configured to generate magnetic force when the coil is energized;

a fixed core configured to generate magnetic attraction force by the magnetic force generated by the coil;

a movable core movable relative to the fixed core by the magnetic attraction force generated by the fixed core;

a diaphragm fixed to the movable core and configured to generate a sound wave by oscillating in accordance with a movement of the movable core;

an acoustic pipe including a sound passage therein extending from a sound passage inlet to a sound passage outlet, the sound passage inlet being an inlet through which the sound wave generated by the diaphragm enters; and a cover including a reflecting wall distanced from and facing to an outlet end of the acoustic pipe, the outlet end defining the sound passage outlet, the reflecting wall being configured to reflect the sound wave, wherein a distance between the outlet end of the acoustic pipe and the reflecting wall falls within ±10% of an odd multiple of one-fourth of a wavelength calculated from a fundamental frequency of the alarm sound, or ±10% of an odd multiple of one-fourth of a wavelength calculated from a multiple harmonic of the fundamental frequency.

2. The alarm sound generating apparatus according to claim 1, wherein the distance falls within ±10% of one-fourth of the wavelength calculated from the fundamental frequency, or ±10% of one-fourth of the wavelength calculated from the multiple harmonic of the fundamental frequency.

3. The alarm sound generating apparatus according to claim 1, wherein the distance falls within ±10% of one-fourth of the wavelength calculated from a third, fourth, fifth or sixth harmonic of the fundamental frequency.

4. The alarm sound generating apparatus according to claim 3, wherein the distance between the outlet end of the acoustic pipe and the reflecting wall falls within ±10% of one-fourth of the wavelength calculated from a fourth or fifth harmonic of the fundamental frequency.

5. The alarm sound generating apparatus according to claim 1, wherein the outlet end of the acoustic pipe has a rectangular shape, and the cover includes a pair of sidewalls connecting opposite edges of the outlet end and the reflecting wall.

6. An alarm sound generating apparatus configured to generate an alarm sound, the apparatus comprising:

a coil configured to generate magnetic force when the coil is energized;

a fixed core configured to generate magnetic attraction force by the magnetic force generated by the coil;

a movable core movable relative to the fixed core by the magnetic attraction force generated by the fixed core;

a diaphragm fixed to the movable core and configured to generated a sound wave by oscillating in accordance with a movement of the movable core;

an acoustic pipe including a sound passage inlet through which the sound wave generated by the diaphragm enters, and a sound passage outlet from which the sound wave is emitted; and a cover including a reflecting wall distanced from and facing to the sound passage outlet, the reflecting wall being configured to reflect the sound wave, wherein a distance between the sound passage outlet and the reflecting wall falls within ±10% of an odd multiple of one-fourth of a wavelength calculated from a fundamental frequency of the alarm sound, or ±10% of an odd multiple of one-fourth of a wavelength calculated from a multiple harmonic of the fundamental frequency.

* * * * *